US006644511B2

(12) United States Patent
Hsu et al.

(10) Patent No.: US 6,644,511 B2
(45) Date of Patent: Nov. 11, 2003

(54) CONTAINER FOR DISPENSING A DUAL PHASE FLUID PRODUCT

(75) Inventors: Feng-Lung Gordon Hsu, Tenafly, NJ (US); Richard Thomas Chalmers, New York, NY (US); Philip A. Tarrant, Hoboken, NJ (US); John Michael Paulovich, Hewitt, NJ (US); Edward John Giblin, Hopatcong, NJ (US)

(73) Assignee: Unilever Home & Personal Care USA, a division of Conopco, Inc., Greenwich, CT (US)

( * ) Notice: Subject to any disclaimer, the term of this patent is extended or adjusted under 35 U.S.C. 154(b) by 84 days.

(21) Appl. No.: 10/043,411

(22) Filed: Jan. 11, 2002

(65) Prior Publication Data

US 2003/0132247 A1 Jul. 17, 2003

(51) Int. Cl.[7] ..... B67D 5/56

(52) U.S. Cl. ..... 222/129; 222/145.1; 222/482; 222/464.1

(58) Field of Search ..... 227/129, 145.1, 227/482, 464.1

(56) References Cited

U.S. PATENT DOCUMENTS

| | | | | | |
|---|---|---|---|---|---|
| 594,087 | A | * | 11/1897 | Jenkins | 222/145.1 |
| 989,865 | A | * | 4/1911 | O'connor | 222/192 |
| 1,121,993 | A | | 12/1914 | Eichler | |
| 1,279,667 | A | | 9/1918 | Davis | |
| 1,488,865 | A | * | 4/1924 | Castor | 210/514 |
| 1,589,230 | A | * | 6/1926 | Zirbel | 224/282 |
| 2,544,070 | A | * | 3/1951 | Daniels | 210/514 |
| 2,592,279 | A | | 4/1952 | Heier | 222/145 |
| 2,644,599 | A | * | 7/1953 | Blunt | 215/6 |
| 3,308,953 | A | | 3/1967 | Hinshaw | 210/83 |
| 3,851,800 | A | | 12/1974 | Swain | 222/145 |
| 4,206,856 | A | | 6/1980 | Lobel et al. | 222/564 |
| 4,993,595 | A | | 2/1991 | Bertram et al. | 222/129 |
| 5,115,946 | A | | 5/1992 | Libit | 222/145 |
| 5,215,214 | A | * | 6/1993 | Lev et al. | 222/145.1 |
| 5,325,996 | A | | 7/1994 | Bannigan | 222/133 |
| 5,462,203 | A | * | 10/1995 | Stern | 222/145.1 |
| 5,637,234 | A | * | 6/1997 | McCasland | 210/801 |
| 5,804,082 | A | | 9/1998 | Lowery, Jr. | 210/800 |
| 5,868,946 | A | * | 2/1999 | Nguyen | 210/800 |

* cited by examiner

*Primary Examiner*—Kenneth Bomberg
(74) *Attorney, Agent, or Firm*—Kevin J. Stein

(57) ABSTRACT

A container for dispensing a flowable fluid which has a first liquid and a second liquid disposed within a single chamber and which are separated and positioned one above the other. The container includes a bottle base, a bottle body which extends upward from the bottle base to a bottle finish, a fitment having a pouring spout and is arranged on the bottle body at an end opposite the base. The fitment has a first pouring opening from which a first liquid is dispensed and a second opening from which a second liquid is dispensed. A diptube is connected to one of the pouring openings projects downward from toward the bottle base. The diptube conveys the liquid on the bottom to a pouring spout while the liquid on top is conveyed to the pouring spout by the other pouring opening.

19 Claims, 7 Drawing Sheets

CONTAINER FOR DISPENSING A DUAL PHASE FLUID PRODUCT

BACKGROUND OF THE INVENTION

1. Field of the Invention

The invention relates to a container for simultaneous dispensing of a dual phase fluid.

2. The Related Art

A laundry detergent has recently been developed that has favorable cleaning properties as compared to more conventional liquid laundry detergents. This new laundry detergent has a unique feature as compared to conventional liquid laundry detergent in that the detergent readily settles into two separate liquid phases. While this new formula has been found to be effective as a laundry detergent, it creates a challenge in designing a suitable dispenser.

Many consumer products contain a fluid which is comprised of two liquids which separate when allowed to sit. In use, these products typically require that the user shake the product just prior to use in order to mix the two phases and then dispense the product almost immediately before the two liquids settle and separate. The need to shake the product prior to use may be inconvenient for the user. For instance, if the product is heavy such as those that come in large sizes (e.g. liquid laundry detergent), it may be difficult for the user to shake well. Shaking can also lead to the product spilling if the cap is not on securely or if pressure builds up within the container while shaking. Another hazard present when a user needs to shake the product is the unfortunate incident when the product slips from the user's grip, falls and breaks causing the contents to spill.

It is intended that this recently developed laundry detergent need not be shaken in order to mix the ingredients prior to use. Yet, the fluid comprised of two liquids needs to be dispensed in a controlled fashion so that a desired amount of each liquid is dispensed. Thus, this recently developed multi-liquid laundry detergent has created a need for a dispenser that can dispense each of the separated liquids in a desired amount at the same time and which combine with each other as they are dispensed. Accordingly, there is the need for a container for dispensing a fluid which comprises two separated liquids, but that enables the user to dispense each liquid without the need to mix prior to dispensing such as by shaking.

The art has described numerous containers for use with fluid products having two liquid components. However, these containers do not simultaneously dispense each liquid commingled into a single stream.

For instance, U.S. Pat. No. 5,804,082 (Lowery) describes a container for separating and selective dispensing two liquids of different densities. The Lowery container has a phase separator which divides the container into an upper and lower portion, each of which holds a different liquid. The phase separator traps the liquid of greater density within the lower chamber to permit separation of the two liquids and dispensation of either the liquid of lesser density from the upper chamber through an aperture or the liquid of greater density from the lower chamber through a conduit.

U.S. Pat. No. 1,121,993 (Eichler) describes a gravy dish designed so that the user can dispense either the lean gravy from the bottom of the dish or the fatty gravy from the top of the dish. The dish has a chamber provided with spouts at diametrically opposite ends of the pouring rim and a partition that extends vertically downward from one spout parallel with the vertical sidewall of the chamber. This partition creates a passage for the lean gravy to pass from the bottom of the dish to the pouring spout while the fatty gravy is poured from the diametrically opposite spout. When the gravy dish is tilted one way, the lean gravy is dispensed. When the gravy is tilted in the opposite direction, the fatty gravy is dispensed.

A container for dispensing a multi-component product is described in U.S. Pat. No. 4,993,595 (Bertram). The container has two separate compartments for holding each component of the multi-component product. Each compartment has a separate pouring opening which are contained under a single pouring cap. The components which make up the multi-component product are mixed together when poured from the container. In this type of embodiment, each compartment needs to be filled individually during production, adding to production cost.

Accordingly, it is an object of the present invention to provide a single chamber container to dispense a fluid which is comprised of two separated liquids wherein each liquid is dispensed at the same time and are commingled so as to be dispensed as a single stream.

Another object of the present invention is to provide a single chamber container for dispensing a fluid which is comprised of two separated liquids wherein each liquid is dispensed at the same time and are commingled so as to be dispensed as a single stream without the need to shake the container prior to dispensing.

Another object of the present invention is to provide a single chamber container for dispensing a fluid which is comprised of two separated liquids wherein each liquid is dispensed at the same time and are commingled so as to be dispensed as a single stream and wherein the liquids are dispensed in a predetermined ratio.

Other objects, features and advantages of this invention will become more apparent upon reference of the following detailed description and drawings illustrating preferred embodiments of the invention.

SUMMARY OF THE INVENTION

The present invention is directed to a container for dispensing a flowable fluid, which has a first liquid and a second liquid disposed within a single chamber, wherein the first liquid is separated and positioned above the second liquid, and wherein the first and second liquids are dispensed as a commingled stream. The term fluid as used herein is meant to encompass the combined first and second liquids, whereas, the term liquid refers to a component of the fluid. The fluid as described in the present invention has two components which are the first liquid and the second liquid.

The container, which is particularly formed of plastic, includes a bottle base, a bottle body which extends upwardly from the bottle base to a bottle finish, and afitment having a pouring spout. The fitment is arranged on the bottle body at an end opposite the base. The fitment has a first pouring opening from which the first liquid is dispensed and a second pouring opening from which the second liquid is dispensed. The container may have a top closure which is removable secured to the bottle or fitment. The top closure is preferably made of polypropylene.

A diptube for conveying the second liquid of the fluid to the pouring spout is connected to the second pouring opening and projects downwardly toward the bottle base.

In accordance with the invention, the bottle body extends upwardly from the bottle base and ends in a bottle finish. The finish may include one or more inner locking surfaces disposed to abut the outer wall of the pouring fitment. The pouring fitment has a floor in which the first and second pouring openings are located. The floor may be at a slope and have a drainback feature or vent to facilitate use. The floor may be raised from the bottom of the pouring fitment and connected to the outer wall of the pouring fitment. This will raise the pouring openings further above the fill-line (i.e. the top level of the top liquid when the container is filled for use) increasing the headspace between the top level of the top liquid and the pouring openings. This embodiment further enables the liquids to be poured out at a predetermined ratio from the first use.

The diptube functions to carry the second liquid from the bottom of the chamber to the second pouring opening of the pouring fitment. This enables the second liquid to be poured out simultaneously with the first liquid which sits on top of the second liquid. The first liquid is poured out of a first pouring opening when the bottle is tilted to pour out the contents.

In one of the embodiments according to the present invention, the diptube extends downward from the second pouring opening toward the bottle base. The diptube should be long enough so that its bottom end extends into the second liquid (i.e. the bottom liquid). Preferably, the bottom opening should be cut on a slant to facilitate ingress of liquid. The diptube may also be flared outward at the bottom to form a larger opening for collecting the bottom liquid. Furthermore, the bottom of the diptube may be shaped or designed with a feature to help hold it in place. It is preferable that the diptube extends to just short of the bottle base so that as the level of the first and second liquids are reduced as the product is used, the diptube will remain below the bottom level of the first liquid (i.e. the top liquid). Accordingly, the bottom of the diptube should extend into the second liquid anywhere from 1–99%. It is preferable that the bottom of the diptube extends at least 50% into the second liquid. It is more preferable that the bottom of the diptube extends at least 80% into the second liquid. It is even more preferable that the bottom of the diptube extends at least 90% into the second liquid. It is even more preferable that the bottom of the diptube extends at least 95% into the second liquid. It is inevitable that, as the product is used, the level of the fluid gets below a certain amount that the bottom level of the first liquid will be below the bottom of the diptube and that both liquids may be dispensed through the diptube. The closer the bottom end of the diptube is to the bottle base, the longer the diptube will remain below the bottom level of the first liquid. Accordingly, it is preferred that the diptube is as close to the bottle base as possible.

In another embodiment according to the present invention the diptube is integrally molded into the sidewall of the bottle opposite the handle. As in the other embodiment, the top end of the diptube is connected or in close proximity to the first pouring opening. If the connection is not integrally molded into the bottle body, then it may be necessary to have a short tube that extends from the first pouring opening to the top opening of the integrally molded diptube.

DETAILED DESCRIPTION OF THE DRAWINGS

The features, advantages and objects of the present invention will more fully be understood by consideration of the drawings describing embodiments thereof in which.

In each of the Figures above, like numerals indicate like items.

DETAILED DESCRIPTION OF THE INVENTION

Figure 1:
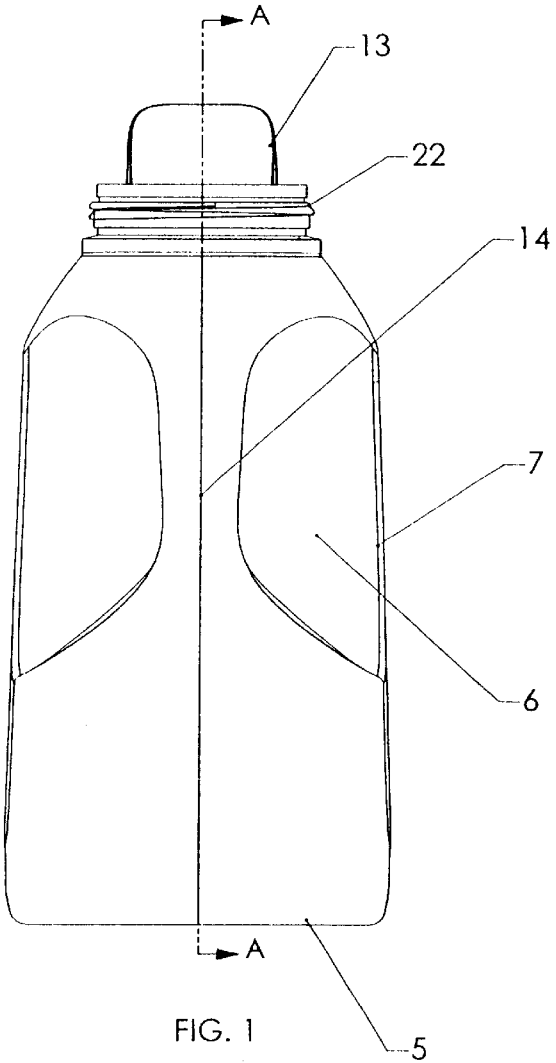
FIG. 1 is a side view of a container according to the present invention.
Figure 2:
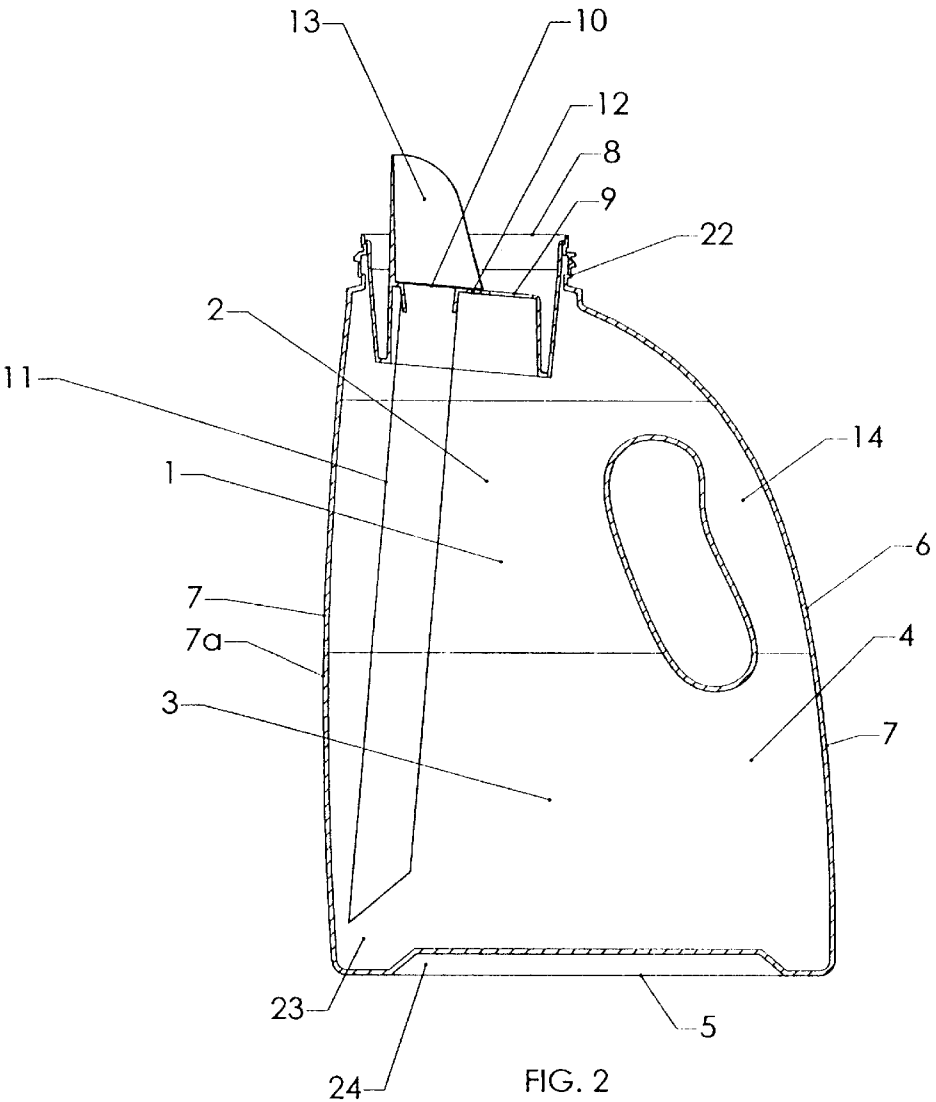
FIG. 2 is a cross-sectional view along line A—A of FIG. 1.

A container according to the present invention in shown in FIGS. 1 and 2. A fluid 1 comprised of two separated liquids 2 and 3 is contained in a single chamber 4. The container 4 has a bottle base 5 and a bottle body 6. The bottle body includes sidewalls 7 which extend upwardly from the bottle base 5 to a bottle finish. The sidewalls may also form a bottle handle or gripping feature 14 as part of the bottle body. Preferably, the bottle's sidewall 7*a* opposite the handle or gripping feature 14 should be as flat as possible, and the neck finish 8, spout 13, and pouring fitment should be as close to the sidewall 7*a* as possible. However, the bottom portion of the sidewall 7*a* may be shaped in a, "V" or curved so as to collect the liquid in the bottom corner of the bottle where it enters the diptube II. The finish may include one or more inner locking surfaces disposed to abut the outer wall of the pouring fitment.

The fitment 8 has two pouring openings 9 and 10 in the floor 12 which enable each of the separated liquids 2 and 3 to be poured from the container 1. Preferably, the two openings 9 and 10 are separated by a section of the spout's floor 12. As the bottle is tipped, the floor 12 acts as a dam which holds back the first liquid 2 from being poured until the level rises to the level of the first pouring opening 9 at which time the first liquid 2 is dispensed through the first pouring opening 9. The floor amount of space between the first and second pouring openings 9 and 10 may be altered to facilitate pouring of each liquid at a desired ratio. A diptube 11 projects downwardly from the pouring opening 10 toward the bottle base 5 for conveying the second liquid 3 (i.e. the liquid that sits on the bottom of the container) to the pouring spout 13. Preferably, the diptube 11 should be as close as possible to the sidewall 7*a* opposite the handle or gripping feature 14. Also, it is preferable that the diptube 11 extend into the area of the bottle's lower bottom chime 23 (opposite the side of the handle or gripping feature 14. The bottom of the diptube 11 may be positioned between the bottle's chime 23 and the inner push-up wall 24, which will help keep the diptube 11 in place. The bottle's chime 23 may also be slightly raised beneath the diptube 11 so as to contact the tip of the diptube in order to assist in securing the diptube 11 in its proper position.

Figure 3:
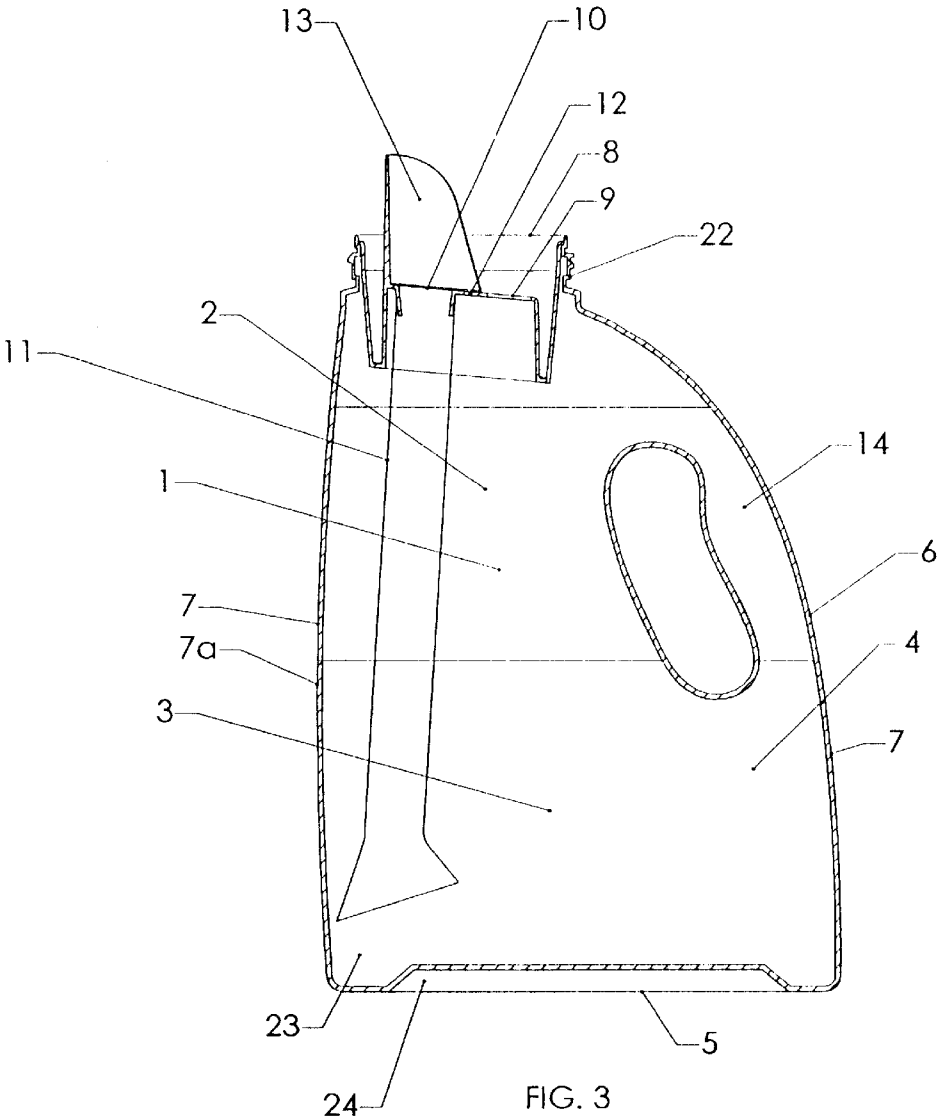
FIG. 3 is a cross-sectional view of a container according to the present invention with a Flared diptube.

FIG. 3 illustrates an embodiment similar to that shown in FIG. 2 where the bottom of the diptube 11 is flared outward to form a larger opening for collecting the bottom liquid.

Figure 4:
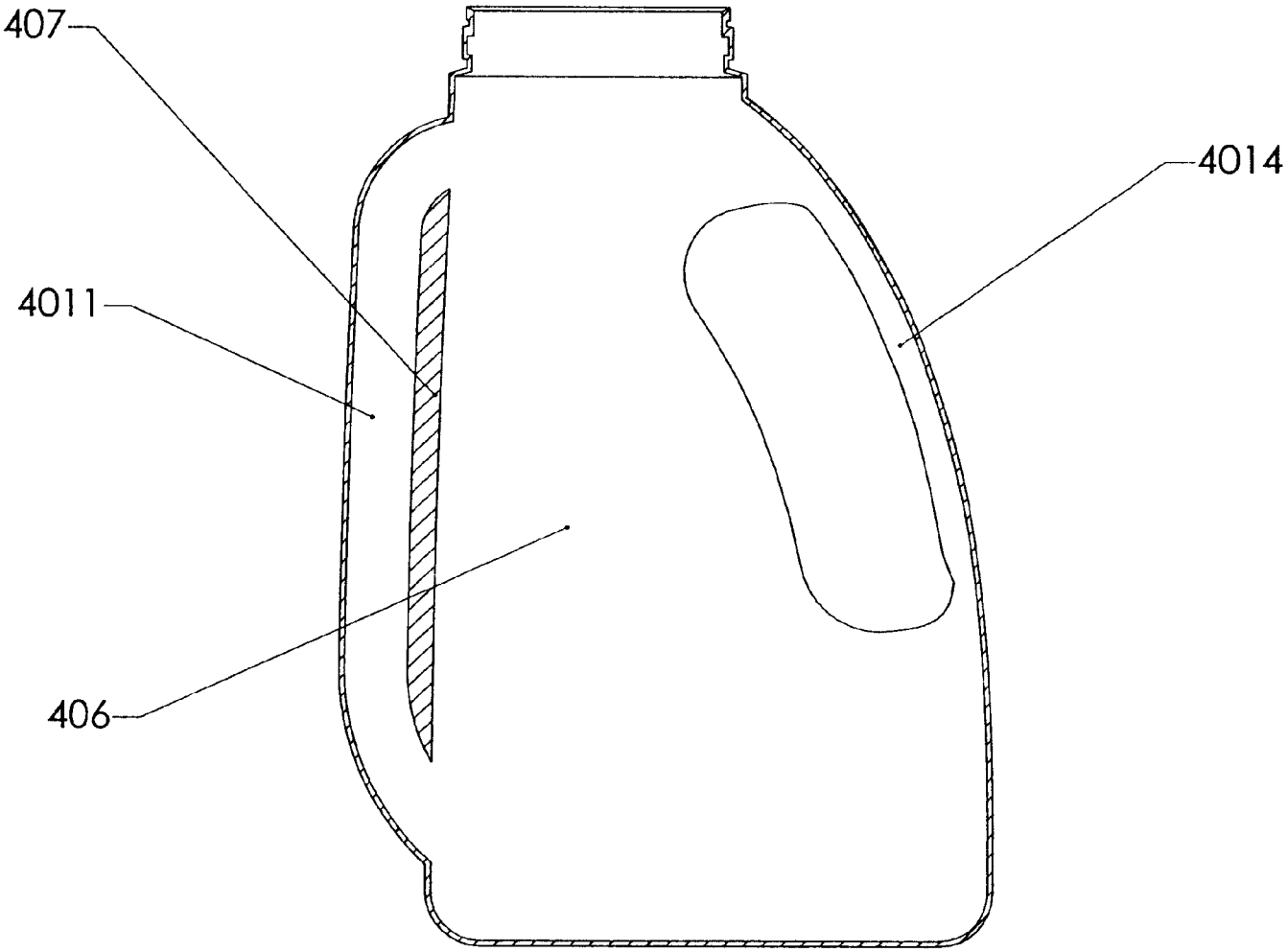
FIG. 4 is a front cross-sectional view of a container embodiment according to the present invention having an integrally molded diptube.

FIG. 4 illustrates another embodiment according to the present invention. In this embodiment, the diptube 4011 is integrally molded into the side of the bottle body 406 opposite the handle or gripping feature 4014. As in the other embodiments discussed herein, the diptube projects downward from the pouring opening 10 toward the bottle base 5. As shown, the diptube 11 is on the exterior of the bottle sidewall 7. The diptube 11 may also be positioned so that it is integrally molded on the inside of the bottle sidewall 7 or as part of the bottle sidewall 7 (not shown).

The pouring openings may assume any form, shape and size suitable for permitting outward flow of the desired liquid. It may be desired that pouring openings assume different sizes and shapes in order to facilitate filling of the container during production. Also, the pouring openings may assume different sizes and shapes so that each liquid is dispensed in a desired predetermined amount. The area of the diptube and pouring openings are sized to deliver the desired flow and delivery of each of the first liquid (i.e. liquid sitting on top of the second liquid) and second liquid (i.e. bottom liquid). For instance, if the fluid in the container is comprised of 70% of a first liquid and 30% of a second liquid, the first pouring opening may be larger than the second pouring opening since the fluid has more of the first liquid. Furthermore, numerous properties, such as viscosity, may influence the size selected for each pouring opening. There is no requirement that pouring openings each assume the same shape and/or size.

The fitment can take various forms to facilitate filling the container with fluid product during production. An important feature of the fitment design is to provide a means for a filling nozzle to dispense the fluid into the container. The container may be filled by either a single stream of fluid comprising multiple liquids, multiple streams each comprising a different liquid or multiple streams each comprising multiple liquids. FIGS. 4–9 demonstrate various designs for the fitment, which have different means for enabling a filling nozzle to provide the fluid to the container during manufacture.

Figure 6:
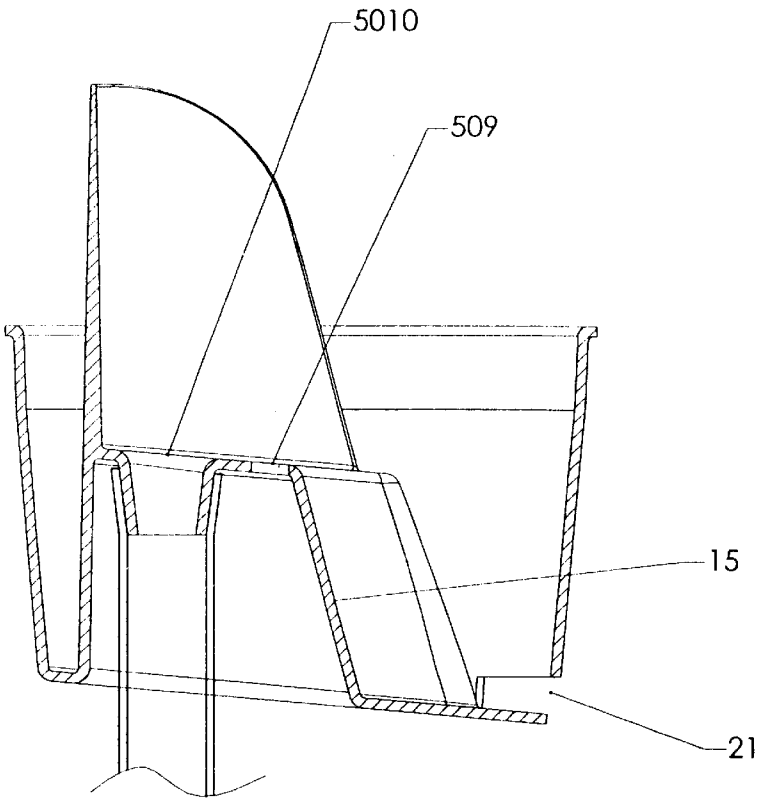
FIG. 6 is a side cross-sectional view along line B—B of FIG. 4.
Figure 5:
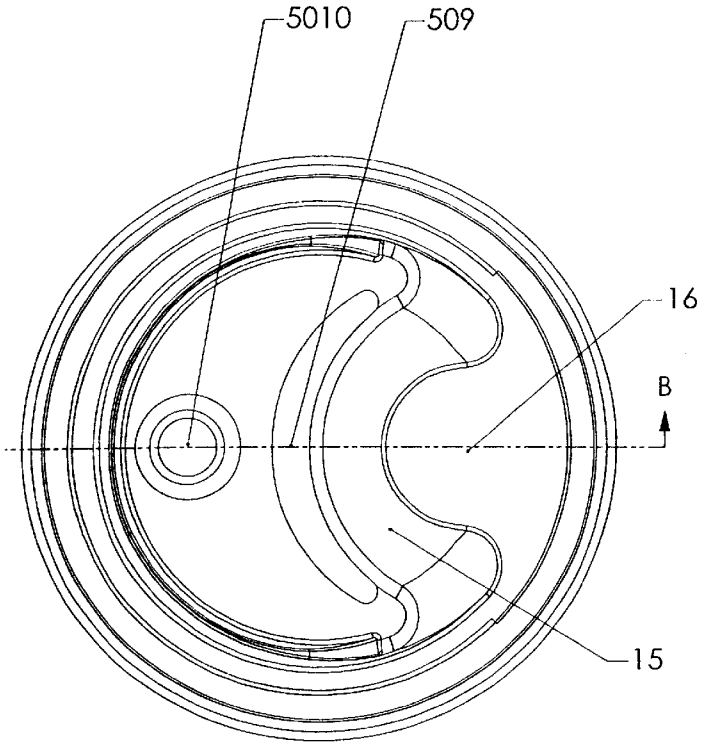
FIG. 5 is a top view of a first embodiment of pouring fitment according to the present invention.

FIGS. 5 and 6 illustrate a fitment embodiment wherein pouring opening 5010 has a circular shape and pouring opening 509 is a semi-circular slit. As the bottle is tipped, more of the first (top) liquid is dispensed as the opening's 509 area increases. The fitment may also have a drainback or vent hole 21. In this embodiment, the fitment has wall 15 and a filling opening 16 at the bottom of the wall 15. The wall 15 is at an angle to facilitate filling the container. When filling the container, a filling nozzle shoots a stream of the fluid comprised of multiple liquids toward the wall 15. This stream is diverted by the angled wall 15 to flow through the filling opening 16. The multiple liquids may also be delivered to the container by multiple streams. For example, one stream comprising a first liquid and a second stream comprising a second liquid. In this case, each of the streams would be diverted by the wall 15 to flow through the filling opening 16.

Figure 7:
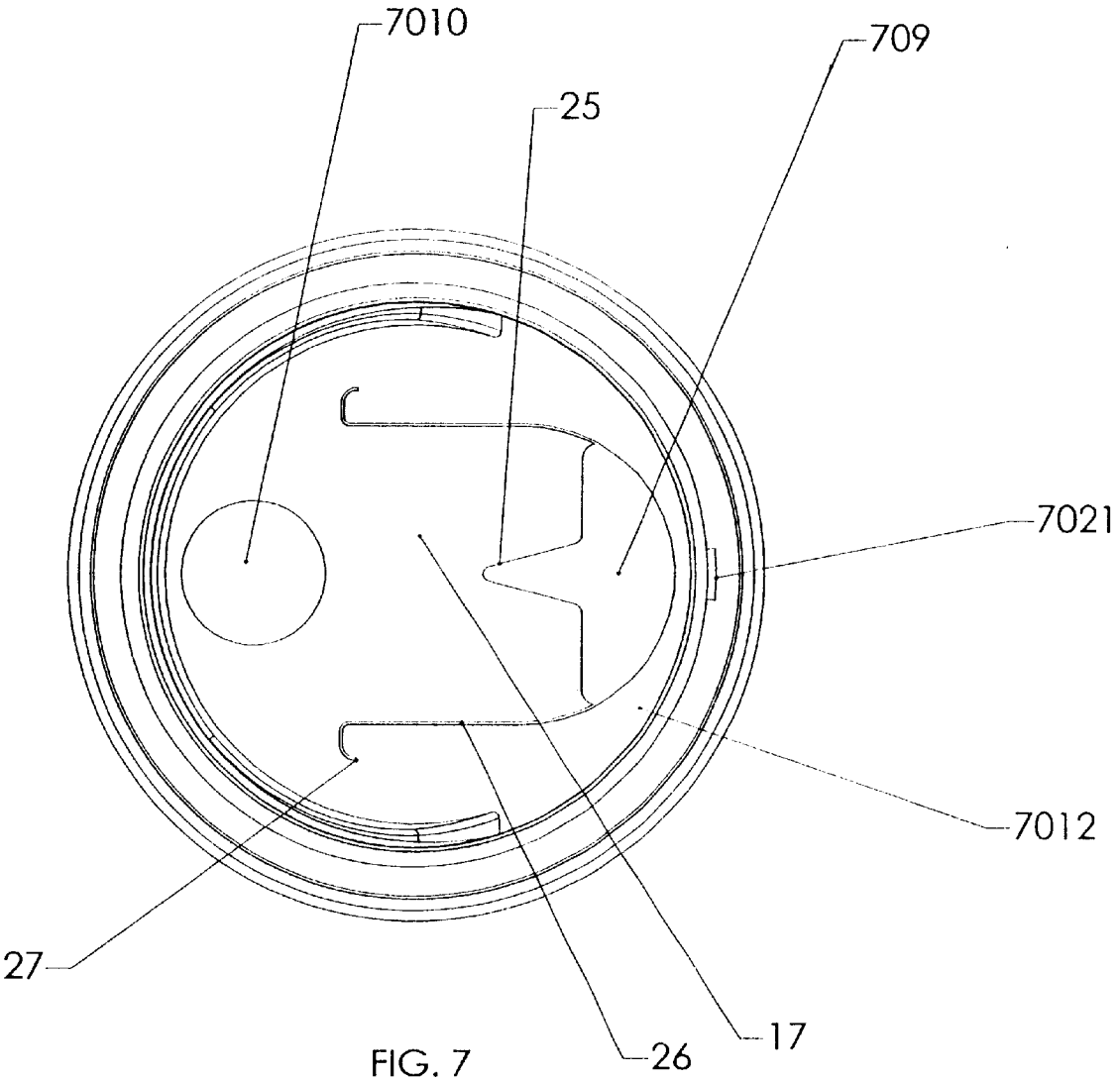
FIG. 7 is a top view of a second embodiment of a pouring fitment according to the present invention.

FIG. 7 illustrates an embodiment of a fitment wherein pouring opening 7010 has a circular shape and pouring opening 709 is generally semicircular in shape with a forward "V" shape 25 which allows more of the first liquid (i.e. top liquid) to be dispensed the more the bottle is tipped. The fitment may also have a drainback or vent hole 7021. In this embodiment, the floor 7012 has a door 17, which can be pushed downward by a filling nozzle, a device on the filling nozzle or by any other means to push the door downward to facilitate filling the bottle. The door is simply formed by cuts 26 in the spout floor 12 that connect to pouring opening 709. Preferably, "j-cuts" 27 are made at the end of the cuts defining the door in order to prevent propagation of the cuts. In this embodiment it is imperative that the floor 7012 be made of a flexible material so that it may be flexed downward to enable the filling nozzle to be inserted. After the filling nozzle has been inserted and the filling has been completed, the filling nozzle is retreated and the door section 17 would return to near its original position and the pouring opening 709 would return to its original shape and size. Preferably, the door section 17 returns to about level with the floor 7012 of the pouring fitment. Preferably, floor 7012 is upwardly curved (i.e. convex) which provides a spring/hinge action for door 17.

Figure 8:
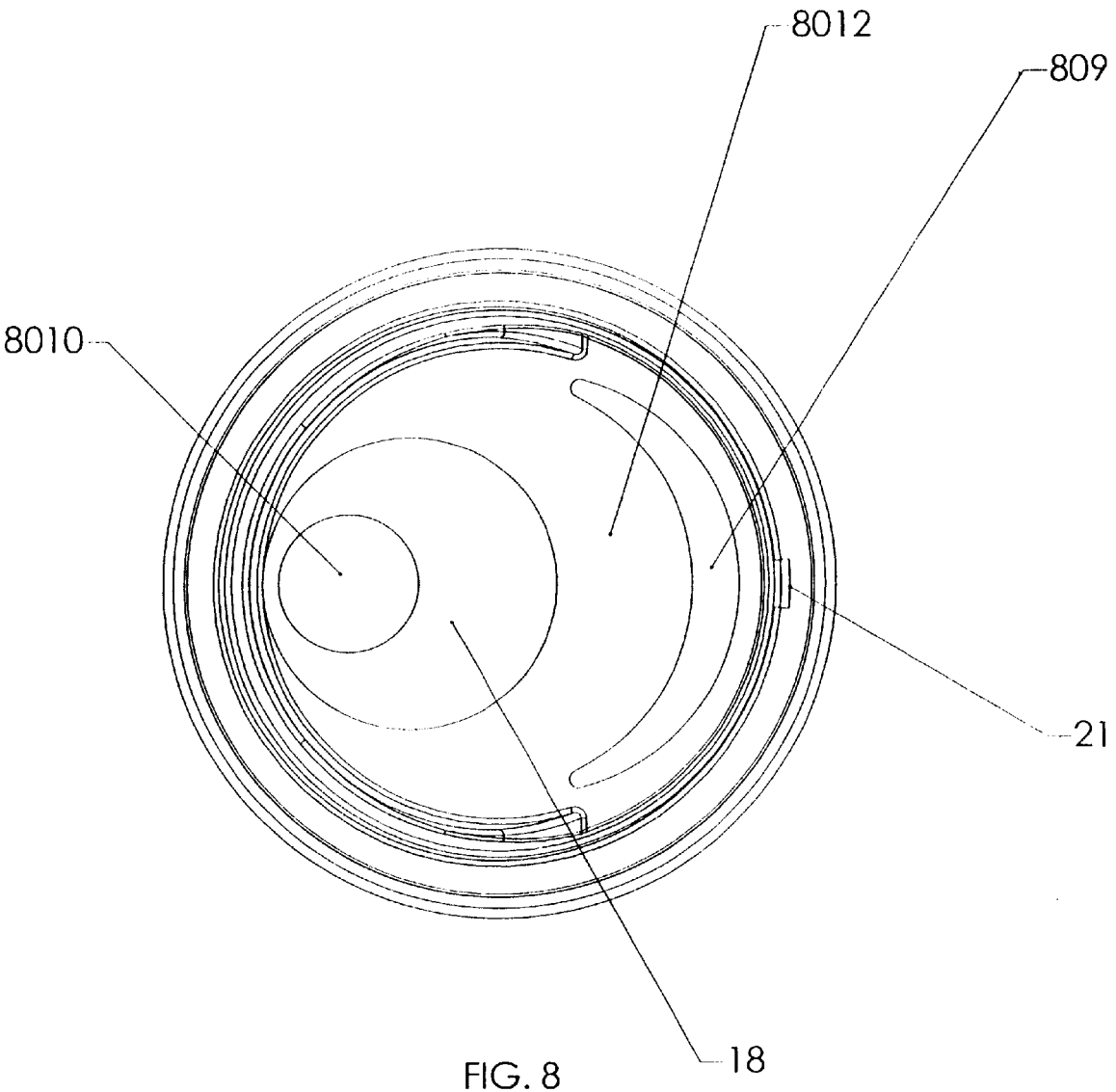
FIG. 8 is a top view of a third embodiment of a pouring fitment according to the present invention.

FIG. 8 illustrates another embodiment for the fitment. In this embodiment, the pouring opening 809 is a semicircular slit. Pouring opening 8010 is circular in shape. The top end of the diptube has a flange 18. The fitment may also have a drainback or vent hole 8021. During filling, the diptube with flange 18 is removed to provide an opening large enough for the filling nozzle to be inserted. Once the chamber is filled, the filling nozzle is removed and the diptube is inserted with the flange 18 fitting generally flush with the floor 8012. The flange acts as a plug so that the size of the pouring opening 8010 is equal to the size of the diptube opening. The flange 18 can be fastened to the floor 8012 by any means, preferably by a snap or friction fit. The size of the flange may vary as needed in order to facilitate the filling nozzle.

Figure 9:
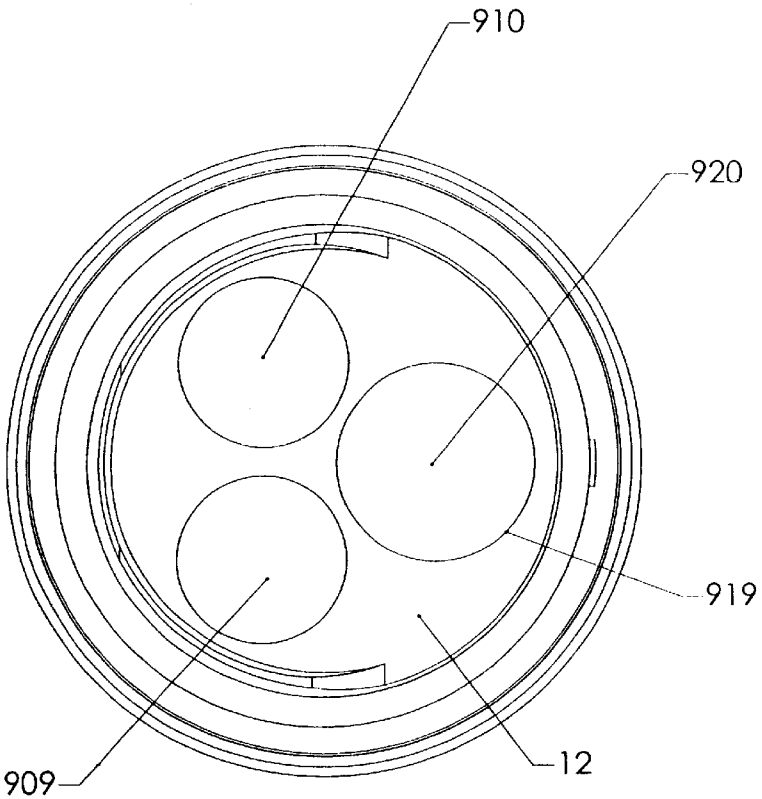
FIG. 9 is a top view of a fourth embodiment of a pouring fitment according to the present invention.

FIG. 9 illustrates yet another embodiment for the fitment. In this embodiment, the floor of the pouring spout has first and second pouring openings 909 and 9010 as well as, a third opening 919 to facilitate the filling nozzle. Once the filling nozzle is removed after filling the chamber, the opening 919 is closed with a disc shape plug 920. The plug 920 may be fastened by any means, preferably a snap fit. The plug should preferably lay generally flat with the floor 12. The opening 919 may be of any size and shape that is required to enable the filling nozzle to be inserted into the chamber. The opening 919 may also be located anywhere in the spout floor 12.

Figure 10:
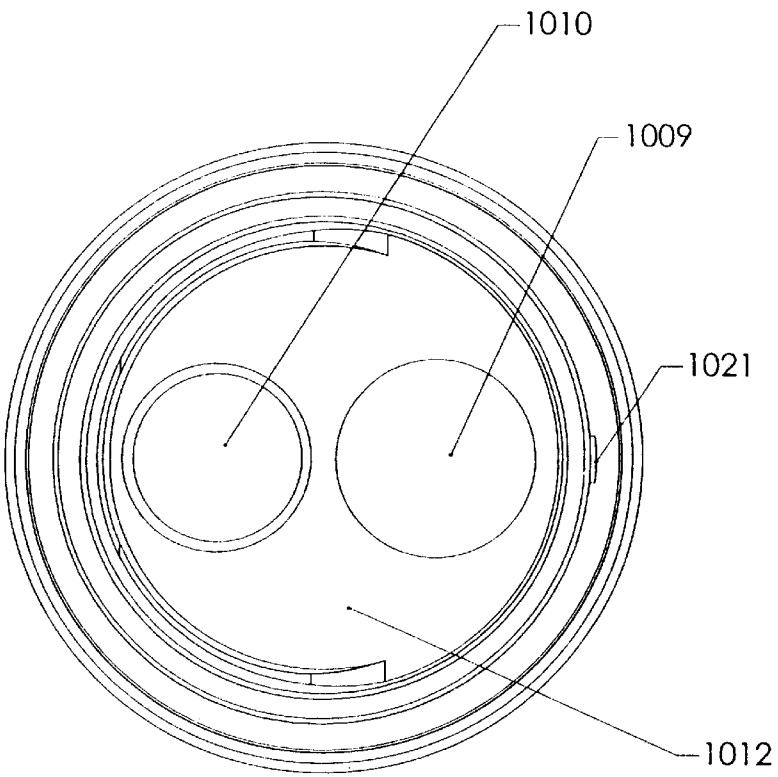
FIG. 10 is a top view of a fifth embodiment of a pouring fitment according to the present invention.

FIG. 10 illustrates yet another embodiment for the fitment. In this embodiment, the pouring openings 1009 and 1010 are sized so that a filling nozzle can be inserted into one or both of the openings. Preferably, the size of one or both of pouring openings 1009 and 1010 ranges from 0.5 inches to 2 inches in diameter. More preferably, the sizes range from ⅝ inch to 1.5 inches and even more preferably from ¾ inch to 1 inch in diameter. In this embodiment there is no need to have a flexible door in the floor of the fitment or a removable plug-like piece to temporarily enlarge the opening for the filling fitment to be inserted for filling purposes.

Referring to FIG. 1, in use the container of the present invention is filled with a fluid, which is comprised of two liquids, which readily separate so that one liquid sits above the other liquid. The container is held by the handle or gripping feature and tilted in the direction opposite the handle. When tilted, the bottom liquid flows up the diptube and dispenses through pouring opening 9. The top liquid dispenses through the pouring opening 9. The two liquids are dispensed onto the other pouring spout 13 where they commingle with each other prior to flowing off the pouring spout as a single stream of fluid.

The container, as well as other components, of the present invention are preferably made of plastic material. Some or all of these components may be made of either opaque, translucent or transparent material if desired. For instance, the bottle body may be made of a translucent material while the fitment and diptube are made of an opaque material. If preferred, all the components may be made of the translucent material.

The bottle, spout and/or diptube could be made of high-density polyethylene (HDPE), natural or clarified polypropylene (PP), polyvinyl chloride (PVC) or polyethylene terephalate (PET). Preferably, the bottle and spout are made of materials of different stiffness. A better seal is formed between a soft and hard component, such as a PP spout in a HDPE bottle, or a HDPE spout in a PET bottle. The spout should be inserted into the bottle soon after blow molding and trimming and reaming, when the bottle is still warm. This will allow the bottle to shrink around the spout forming a better seal.

The present invention has been discussed in the context of dispensing a dual phase liquid laundry detergent. Of course, the present invention may be used in dispensing other products including, but not limited to fabric softeners and conditioners, light duty liquid detergents for hand washing dishes (LDL), automatic dishwashing detergents for machine wash (ADG), hard surface cleaners, liquid hand soaps, shampoos and shower gels.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

What is claimed is:

1. A container for dispensing a flowable fluid, wherein said fluid has a first liquid and a second liquid disposed within a single chamber, wherein said first liquid is separated and positioned above said second liquid;

said container comprising a) a bottle base;

b) a bottle body extending upwardly from said bottle base to a bottle finish;

c) a fitment having a pouring spout, the fitment arranged on said bottle body at an end opposite the base, wherein said fitment has a first pouring opening from which said first liquid is dispensed and a second opening from which said second liquid is dispensed; and d) a diptube connected to said second pouring opening and which projects downwardly from said second pouring opening toward said bottle base for conveying said second liquid of said fluid to the pouring spout.

2. A container according to claim 1 wherein said diptube is integrally molded with said bottle body.

3. A container according to claim 1 wherein the first and second liquids are dispensed in a predetermined ratio.

4. A container according to claim 1 wherein said bottle base and bottle body are made of translucent or transparent material.

5. A container according to claim 1 wherein said bottle base, bottle body and pouring fitment are made of translucent or transparent material.

6. A container according to claim 1 wherein said first and second liquids are dispensed as a commingled stream of liquids.

7. A container according to claim 1 wherein said diptube extends into said second liquid at least 50%.

8. A container according to claim 1 wherein said diptube extends into said second liquid at least 80%.

9. A container according to claim 1 wherein said diptube extends into said second liquid at least 90%.

10. A container according to claim 1 wherein said diptube extends into said second liquid at least 95%.

11. A container according to claim 1 wherein said fitment has a means for filling the chamber with said fluid.

12. A container according to claim 11 wherein said means for filling the chamber with said fluid comprises a flexible door in said fitment which flexes downward to facilitate filling and returns to near its original shape and size after filling.

13. A container according to claim 11 wherein said means for filling the chamber with said fluid comprises an orifice for filling which is plugged after the container is filled.

14. A container according to claim 13 wherein said hole for filling is the second pouring opening and said plug is comprised of a flange connected to the top end of said diptube.

15. A container according to claim 11 wherein said means for filling the chamber with said fluid comprises at least one of said first or second pouring openings.

16. A container according to claim 1 wherein said diptube is flared at its bottom.

17. A product comprising:

a flowable fluid having a first liquid and a second liquid disposed within a single chamber, wherein said first liquid is separated and positioned above said second liquid;

a container comprising:

a) a bottle base;

b) a bottle body extending upwardly from said bottle base to a bottle finish;

c) a fitment having a pouring spout, the fitment arranged on said bottle body at an end opposite the base, wherein said fitment has a first pouring opening from which said first liquid is dispensed and a second pouring opening from which said second liquid is dispensed; and d) a diptube connected to said second pouring opening and which projects downwardly from said second pouring opening toward said bottle base for conveying said second liquid of said fluid to the pouring spout.

18. A product according to claim 17 wherein said fluid is a detergent.

19. A container capable of dispensing a flowable fluid comprising first and second liquids arranged one above the other in a single chamber and dispensable as a commingled stream of liquids, the chamber comprising:

a) a bottle base;

b) a bottle body extending upwardly from said bottle base to a bottle finish;

c) a fitment having a pouring spout, the fitment arranged on said bottle body at an end opposite the base, wherein said fitment has a first pouring opening from which said first liquid is dispensed and a second opening from which said second liquid is dispensed; and d) a diptube connected to said second pouring opening and which projects downwardly from said second pouring opening toward said bottle base for conveying said second liquid of said fluid to the pouring spout.

* * * * *